US007070002B2

(12) United States Patent
Sundholm et al.

(10) Patent No.: US 7,070,002 B2
(45) Date of Patent: Jul. 4, 2006

(54) FIRE EXTINGUISHING METHOD AND APPARATUS

(75) Inventors: Göran Sundholm, Tuusula (FI); Maarit Tuomisaari, Espoo (FI)

(73) Assignee: Marioff Corporation OY, Vantaa (FI)

( * ) Notice: Subject to any disclaimer, the term of this patent is extended or adjusted under 35 U.S.C. 154(b) by 0 days.

(21) Appl. No.: 10/486,554

(22) PCT Filed: Sep. 10, 2002

(86) PCT No.: PCT/FI02/00726

§ 371 (c)(1),
(2), (4) Date: Aug. 18, 2004

(87) PCT Pub. No.: WO03/024533

PCT Pub. Date: Mar. 27, 2003

(65) Prior Publication Data

US 2005/0000701 A1 Jan. 6, 2005

(30) Foreign Application Priority Data

Sep. 19, 2001 (FI) ..... 20011840

(51) Int. Cl.
*A62C 3/00* (2006.01)
*B05B 3/00* (2006.01)

(52) U.S. Cl. ..... 169/46; 169/14; 169/16; 169/54; 239/207; 239/208; 239/209

(58) Field of Classification Search ..... 239/207–210; 169/54, 14, 16, 46, 44
See application file for complete search history.

(56) References Cited

U.S. PATENT DOCUMENTS

| | | | | |
|---|---|---|---|---|
| 635,364 | A * | 10/1899 | Utman | 137/357 |
| 1,826,072 | A * | 10/1931 | Hamilton | 169/17 |
| 2,196,592 | A | 4/1940 | Lowe et al. | |
| 5,269,344 | A | 12/1993 | McHugh | |
| 5,588,493 | A | 12/1996 | Spector et al. | |
| 5,918,680 | A | 7/1999 | Maranghides | |
| 6,158,519 | A | 12/2000 | Kretschmer | |
| 6,182,767 | B1 | 2/2001 | Jackson | |
| 6,216,793 | B1 | 4/2001 | Sundholm | |
| 6,371,212 | B1 * | 4/2002 | Jackson | 169/37 |
| 6,422,319 | B1 * | 7/2002 | Haase, III | 169/16 |
| 6,763,894 | B1 * | 7/2004 | Schoenrock et al. | 169/47 |

* cited by examiner

*Primary Examiner*—David A. Scherbel
*Assistant Examiner*—Seth Barney
(74) *Attorney, Agent, or Firm*—Ladas and Parry LLP

(57) ABSTRACT

Fire extinguishing method, especially for spaces intended for the storage of aircraft, such as hangars, in which method a fire extinguishing medium, especially a liquid mist, is sprayed via at least one first nozzle (2) in the area, seen in a vertical direction, between an object (1) to be protected/extinguished, such as an aircraft, and the floor (3) or equivalent af the storage space. At least one first nozzle (2) is arranged to spray mainly in the area between the object (1) to be extinguished, such as an aircraft, and the floor (3) of the storage space or equivalent at least in a horizontal plane mainly in one first direction.

20 Claims, 3 Drawing Sheets

FIRE EXTINGUISHING METHOD AND APPARATUS

BACKGROUND OF THE INVENTION

Figure 1:
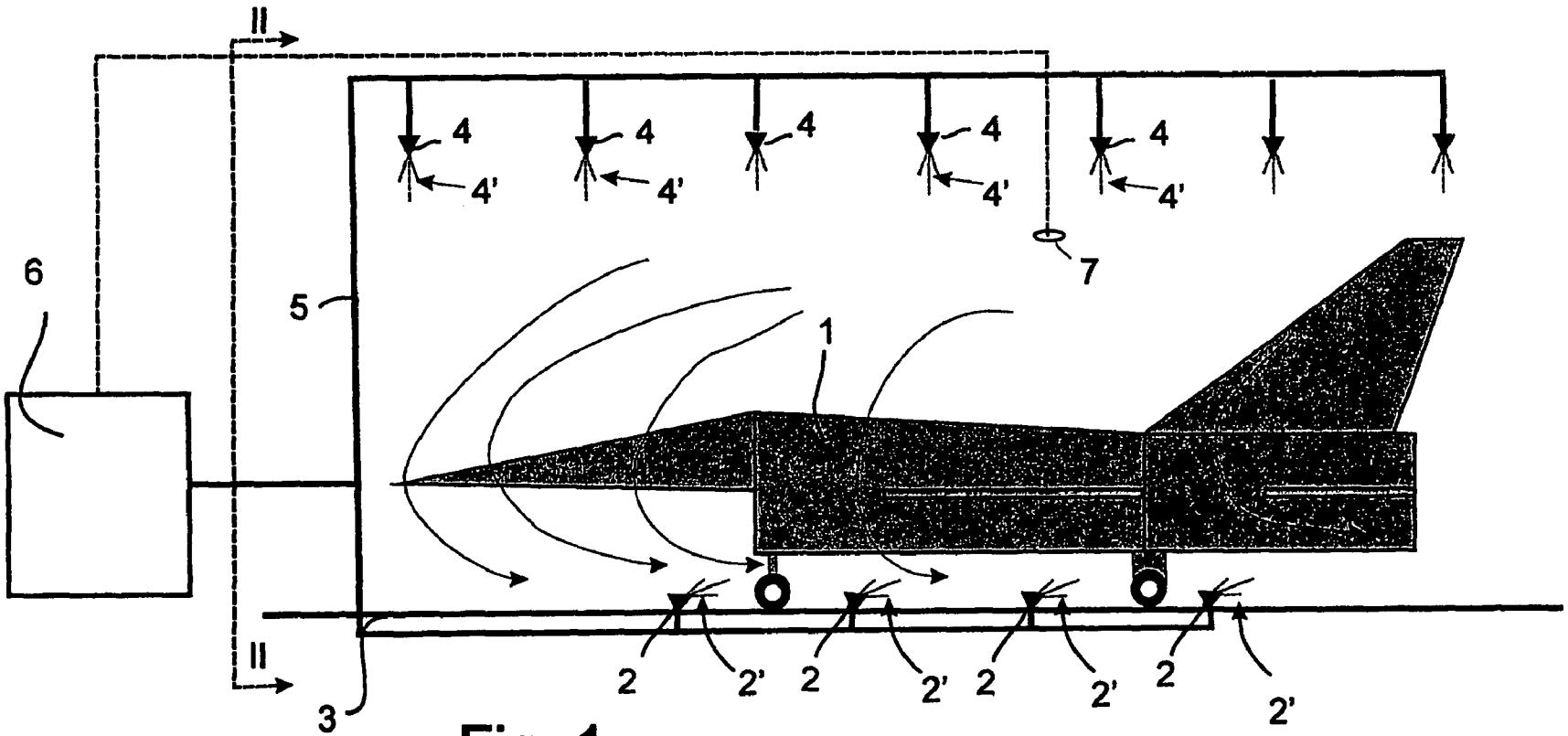

The present invention relates to a fire extinguishing method as defined in the preamble of claim 1, especially for spaces intended for the storage, maintenance, testing etc. of aircraft, such as hangars, in which method a fire extinguishing medium, especially a liquid mist, is sprayed, via at least one first nozzle in an area, seen in a vertical direction, between an object to be protected/extinguished, such as an aircraft, and the floor of the space or equivalent.

The invention also relates to a fire extinguishing apparatus as defined in the preamble of claim 12, especially for spaces intended for the storage, maintenance, testing etc. of aircraft, such as hangars, said apparatus comprising at least one first nozzle, which, when activated, is directed to spray an extinguishing medium, especially a liquid mist, in the area, seen in a vertical direction, between an object to be protected/extinguished, such as an aircraft, and the floor of the storage space, and means for supplying an extinguishing medium to the afore-said nozzles.

Fire extinguishing systems of spaces, such as various hangars, intended for the storage, maintenance, testing etc. of aircraft, such as airplanes, are very important as a means of protecting the valuable craft from a possible fire. Fires particularly difficult to extinguish are those occurring e.g. under an airplane, especially under its wing. So far, fire extinguishing systems used in hangars typically comprise nozzles installed above the object and/or in the floor, through which is sprayed a fire extinguishing medium, especially extinguishing foam. In such systems, the aim is to fill the entire space between the aircraft and the floor with foam. At the same time, however, efforts are made to prevent adverse effects of the foam on the aircraft. A disadvantage with systems using extinguishing foam is especially the cleaning work required after their application, especially on aircraft. Moreover, to allow such a system to be used, the space in which extinguishing foam is to be applied has to be evacuated before the system is triggered into action, which thus introduces a delay between the detection of fire and activation of the extinguishing system. Fire extinguishing systems using so-called film-forming foam are also known. In these systems, the extinguishing medium forms a film on the surface of objects. One of the disadvantages of these is that they typically have highly corrosive properties, which may damage the object to be protected. Moreover, their effectiveness is limited to only given types of fire. In addition, prior-art fire extinguishing systems are difficult to provide in the spaces to be protected without said systems interfering with other activities carried on in them.

In fire-fighting technology, extinguishing systems based on water mist are also known, the use of which typically does not involve the disadvantages of systems using extinguishing foam.

BRIEF DESCRIPTION OF THE INVENTION

The object of the present invention is to achieve a solution that uses a liquid mist, especially water mist as an extinguishing medium for extinguishing fires in storage spaces for aircraft, such as airplanes. Another object of the invention is to achieve an effective extinguishing solution that can be used to put out fires occurring under an object to be protected, such as an aircraft.

The method of the invention is mainly characterized in that at least one first nozzle is arranged to spray mainly in the area between the object to be extinguished, such as an aircraft, and the floor of the storage space at least in a horizontal plane mainly in one first direction.

The method of the invention is additionally characterized by what is presented in claims 2–11.

The apparatus of the invention is characterized in that at least one first nozzle has been arranged to spray mainly in the area between the object to be extinguished, such as an aircraft, and the floor of the storage space at least in a horizontal plane mainly in one first direction.

The apparatus of the invention is additionally characterized by what is presented in claims 13–22.

The solution of the invention has many significant advantages. According to the invention, the nozzles spraying between the object to be protected and the floor are very effective in subduing the flames of a fire between the object and the floor at an early stage, protecting the bottom of the object even alone. Sprays directed in the same direction boost the effect of each other, with the result that their penetration is increased, among other things. In addition, the mist of extinguishing medium sprayed from nozzles placed above the object to be protected is directed, due to the currents generated, to the area between the object and the floor. The solution of the invention keeps the mist of extinguishing medium very well within the area to be protected, even in is open spaces. The method and apparatus of the invention are very well applicable for fire protection of different aircraft storage spaces. By using the solution of the invention, different types of liquid fires, such as fires in reservoirs or flowing fires of flammable liquids. In the case of such fires, the seat of fire is typically below the object to be protected. The solution of the invention is also well applicable for fire protection of buildings where the distance from the floor to nozzles mounted overhead, e.g. in the ceiling, is relatively large, e.g. 5–10 m. Thus, the solution of the invention can be easily installed in spaces to be protected without interfering with other activities.

BRIEF DESCRIPTION OF ILLUSTRATIONS

Figure 2:
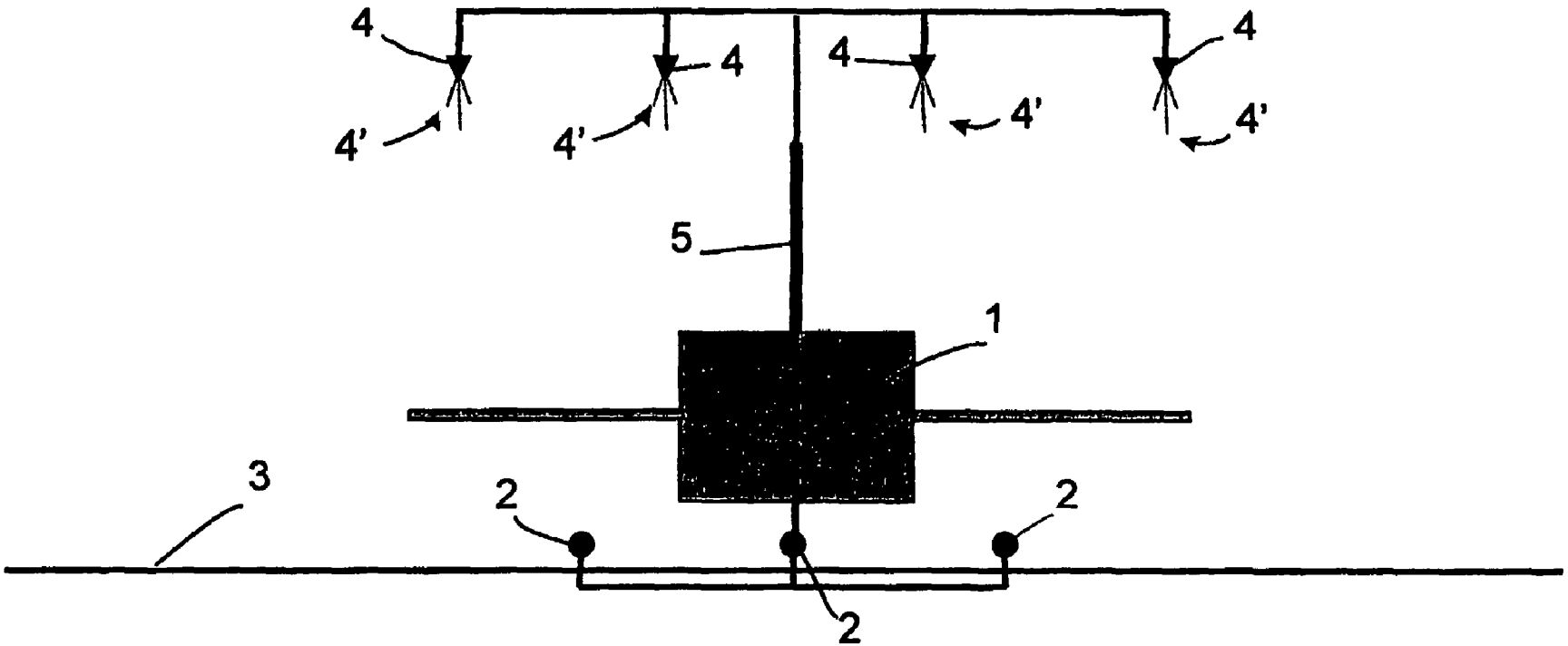
Figure 3:
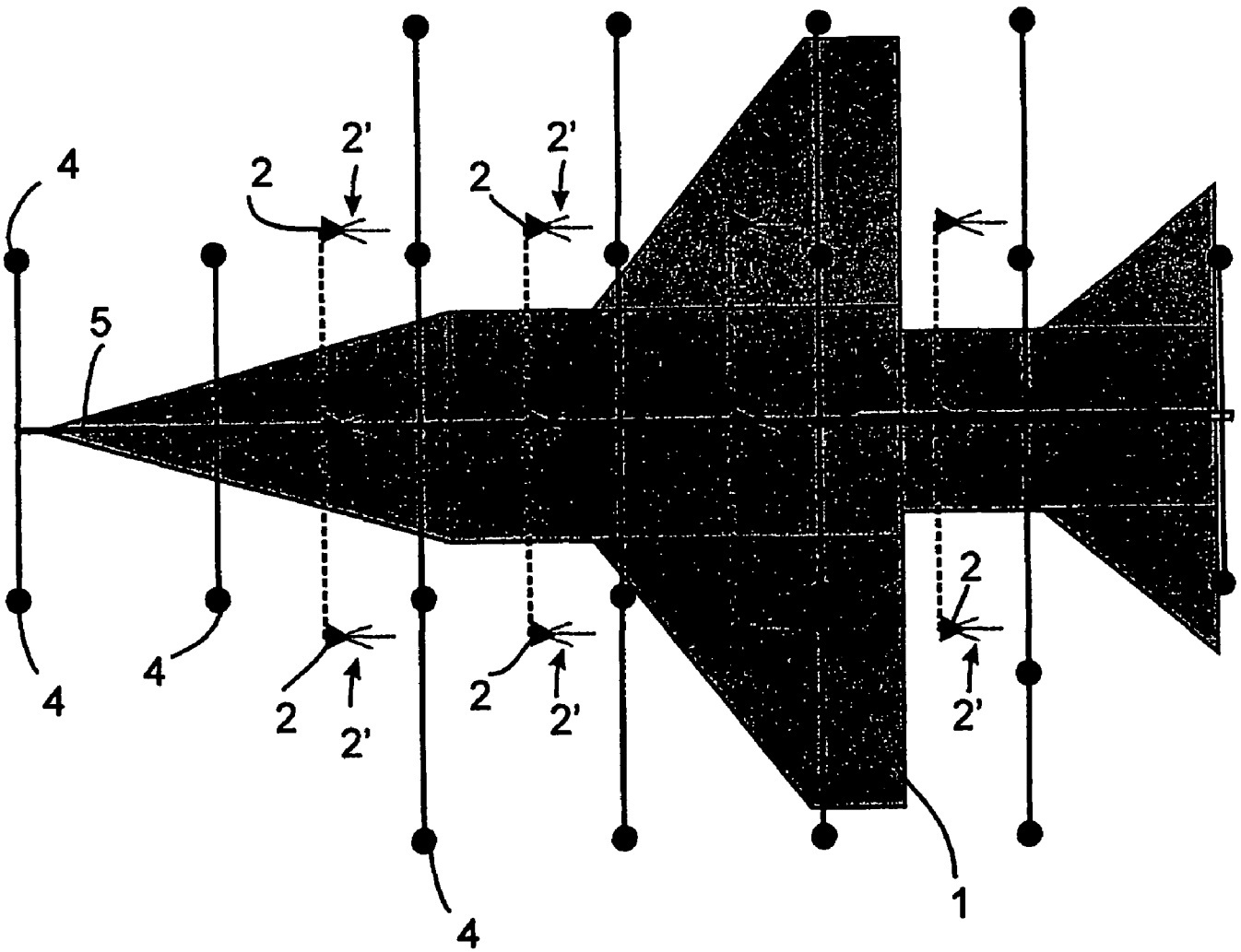

In the following, the invention will be described in detail by the aid of an example with reference to the attached drawings, wherein FIG. 1 presents a diagram of an apparatus according to the invention in side view, FIG. 2 presents an arrangement according to the invention as seen from direction II—II in FIG. 1, and FIG. 3 shows the position of the nozzles in a solution according to the invention, projected onto a horizontal plane.

DETAILED DESCRIPTION OF THE INVENTION

The figures present diagrams representing a fire extinguishing arrangement according to the invention. The arrangement of the invention is designed for fire protection of and extinguishing of fires in spaces intended especially for the storage of aircraft, such as hangars. In the figure, the object 1 to be extinguished, such as an aircraft, is shown in a simplified diagrammatic form. A first nozzle intended for spraying an extinguishing medium is indicated in the figures by reference number 2 and the corresponding spray by reference number 2'. The spray head used to spray the extinguishing medium, which may comprise a plurality of nozzles 2, 4, is not provided with a separate number, but the number representing the nozzle also represents a possible spray head.

The fire extinguishing system typically comprises at least one first nozzle 2, typically, but not necessarily at least one second nozzle 4 and means for supplying an extinguishing medium to the nozzles 2, 4. The means for supplying an extinguishing medium to the nozzles typically comprise an operating unit 6 and a piping system 5 connecting it to the nozzles 2, 4. The system also comprises a fire detector 7, which is connected to the operating unit, the fire extinguishing system being activated on the basis of the signal obtained from the fire detector. It is obvious that the system can be activated in other ways, too, or it can be activated manually. The system may also comprise several operating units 6, and their operation may be independent of each other. Thus, the first nozzles 2 spraying towards the floor may function independently of the second nozzles 4 spraying from above. Therefore, the extinguishing mediums used in the systems may differ from each other. It is thus thinkable that the first nozzles 2 could spray e.g. an at least partially foam-based extinguishing medium while the second nozzles 4 spray a liquid mist.

The nozzles 2, 4 are designed for spraying an extinguishing medium, such as a liquid mist, especially water mist. The fire extinguishing apparatus, especially for spaces intended for the storage of aircraft, such as hangars, comprises at least one first nozzle 2, which, when activated, is directed to spray an extinguishing medium, especially liquid mist, in the area between the object 1 to be extinguished, such as an aircraft, and the floor 3 of the storage space, seen in a vertical direction, and at least one second nozzle 4 above the object to be extinguished, such as an aircraft, and means for supplying an extinguishing medium to said nozzles 2, 4. The first nozzle 2 has been arranged to spray mainly in the area (or the volume) between the target 1 to be extinguished, such as an aircraft, and the floor 3 of the storage space at least in a horizontal plane mainly in one first direction. The first nozzle is arranged to spray the majority of its spray into the area between the object and the floor and with a mainly horizontal vector. At least one other first nozzle 2 has been arranged to spray, when activated, an extinguishing medium at a distance from one first nozzle 2 at least in a horizontal plane mainly in one first direction so that the sprays 2' from the first nozzles 2 boost each other. The nozzles 2, 4 are so disposed relative to each other that, due to the action of the suction created by the spray 2' from at least one first nozzle 2, at least part of the extinguishing medium sprayed by at least one second nozzle 4 is directed into the space between the object 1 to be extinguished, such as the fuselage of an aircraft, and the floor 3. The arrows in FIG. 1 are intended to roughly indicate the circumstance that at least part of the extinguishing medium is directed from above the object 1 into the space below it.

The nozzles 2, 4 are so arranged relative to each other that a plurality of first nozzles 2, when activated, spray an extinguishing medium mainly in one first direction while a plurality of second nozzles 4 spray in at least one second direction, so that the currents generated by the sprays serve to keep the mist of extinguishing medium mainly within the desired area. The second direction is typically different from the first direction. The spray 2' from at least one first nozzle 2 is directed in a horizontal plane mainly in the direction of the longitudinal axis of the aircraft or an axis parallel to it. At least some of the second nozzles 4 are directed to spray the upper part of the object 1 to be protected, such as an aircraft, preferably in a substantially radial direction towards the assumed longitudinal axis of the object. At least some of the first nozzles 2 are disposed one after the other in the direction of the longitudinal axis of the object to be protected and/or side by side at a distance from each other in a direction transverse to the longitudinal axis. At least part of the spray 2' from at least one first nozzle 2 is directed towards the lower part of the object 1 to be protected, such as the bottom of an aircraft. At least one spray 2' from at least one first nozzle 2 is directed obliquely upwards in a vertical plane. A plurality of first nozzles are arranged to spray an extinguishing medium into the area between the floor 3 and the object 1, such as an aircraft, so that the sprays cover a substantial part of the lower surface of the object 1. In the embodiment illustrated in the figures, the first nozzles 2 are directed in a horizontal plane mainly in the direction of the longitudinal axis of the object 1 to be protected. However, it is obvious that they can be directed as required in each embodiment.

The first nozzles/spray heads 2 are typically disposed in the floor 3. The nozzles/spray heads 2 are preferably so arranged that, when activated, they spring upwards from the level of the floor 3, e.g. as described in specification WO93/00962. When a liquid mist, especially water mist is used as an extinguishing medium, the nozzles 2 are preferably of the type described in specification WO01/45799. The second nozzles/spray heads 4 are preferably of the type described in specification WO92/20453.

The operating unit may be e.g. a constant-pressure pump. The pressure in the piping is typically over 30 bar, preferably over 50 bar, most preferably over 70 bar. The liquid mist produced by the nozzles is typically very fine. The droplet size ($D_{v90}$) is typically below 400 micrometers, preferably below 300 micrometers, most preferably below 200 micrometers.

in the arrangements according to the invention, the distance of the second nozzles 4 placed above the object from the floor level 3 is relatively large, e.g. 5–10 meters. The distance between the first nozzles/spray heads 2 may vary depending on application. In a typical case, the distance is 1–5 m, preferably 2–4 m, most preferably about 3 meters. The distance between the second nozzles/spray heads 4 may vary according to application. In a typical case, the distance is 2–6 m, preferably about 3–5 m, most preferably about 4 m.

In the method of the invention, when the system is activated, e.g. in consequence of a fire under the object to be protected, the first nozzles/spray heads 2 start spraying a mist of extinguishing medium in a set direction. The nozzles 2 have been so directed that the sprays 2' from the nozzles/spray heads boost each other, and therefore a very effective impact can be exerted on the flames in the seat of fire. At the same time, a mist of extinguishing medium is also sprayed from the nozzles/spray heads 4 disposed above the object 1 to be protected. Due to the suction generated by the first nozzles 2, currents are formed in he protected area of the object so that the mist of extinguishing medium sprayed from the second nozzles 4 is directed into the area between the object and the floor. Extinguishing medium is sprayed by a plurality of first nozzles 2 mainly in one first direction and by a plurality of second nozzles 4 in at least one second direction, the mist of extinguishing medium being kept within the desired area by the currents thus formed. The spray 2' from at least one first nozzle 2 is directed at least in a horizontal plane mainly in the direction of the longitudinal axis of the aircraft or an axis parallel to it. At least some of the second nozzles 4 are directed to spray substantially towards the upper part of the object 1 to be protected, such as an aircraft, preferably substantially in a radial direction towards the assumed longitudinal axis of the object 1 to be protected. Extinguishing medium is sprayed from a plurality of first nozzles 2, at least some of which have been arranged one after the other in the direction of the longitudinal axis of the object 1 to be protected and/or side by side at a distance from each other in at least one direction transverse to the longitudinal axis. At least part of the spray 2' from at least one first nozzle 2 is directed to spray towards the lower part 1 of the object to be protected, such as the bottom of an aircraft. Part of at least one spray 2' from at least one first nozzle 2 is directed to spray obliquely upwards in a vertical plane. A plurality of first nozzles 2 are arranged to spray an extinguishing medium into the area between the floor 3 and the object 1, such as an aircraft, so that the sprays cover a substantial part of the lower surface of the object 1.

It is obvious to the person skilled in the art that the invention is not limited to the embodiments described above, but that it may be varied within the scope of the following claims.

The invention claimed is:

1. In a fire extinguishing method for at least one of a space, aircraft storage space or hangar in which at least one of fire extinguishing medium or liquid mist is sprayed via at least one first nozzle (2) in an area between at least one of an object (1) to be protected/extinguished or an aircraft and at least one of a floor (3) or equivalent of the space, aircraft storage space or hanger, the improvements wherein:

the at least one of fire extinguishing medium or liquid mist is sprayed via the at least one first nozzle (2) mainly in an area between the at least one of the object (1) or aircraft and the floor (3) or equivalent and at least in a horizontal plane mainly in one first direction; and the at least one of fire extinguishing medium or liquid mist is sprayed via at least one other first nozzle (2) at a distance from and serial to the at least one first nozzle at least in a horizontal plane substantially in the one first direction so that the sprays from the one and other first nozzles boost each other by a suction produced by the sprays.

2. The method according to claim 1, wherein the at least one of the fire extinguishing medium or liquid mist is sprayed via at least one second nozzle (4) from above the at least one of the object or aircraft.

3. The method according to claim 1, wherein, due to the action of suction produced by the spray (2') form the at least one first nozzle (2) at least part of the liquid mist of spray the at least one second nozzle (4) is directed into the area between the at least one of the object (1) or aircraft and the floor (3).

4. The method according to claim 1, wherein, in the method, extinguishing medium is sprayed via a plurality of first nozzles (2) mainly in one first direction and via a plurality of second nozzles (4) in at least one second direction, the mist of extinguishing medium being kept mainly within the desired area by the currents thus formed.

5. The method according to claim 1, wherein the spray (2') from at least one firs nozzle (2) is directed, at least in a horizontal plane, mainly in the direction of the longitudinal axis of the object, such as the aircraft, or an axis parallel to it.

6. The method according to claim 1, wherein at least some of the second nozzles (4) are directed to spray substantially towards the upper part of the object (1) to be protected, such as an aircraft.

7. The method according to claim 1, wherein extinguishing medium is sprayed from a plurality of first nozzles (2), at least some of which have been arranged one after the other in the direction of the longitudinal axis of the object (1) to be protected and/or side by side at a distance from each other in at least one direction transverse to the longitudinal axis.

8. The method according to claim 1, wherein at least part of the spray (2') form at least one first nozzle (2) is directed towards the lower part of the object (1) to be protected, such as the bottom of an aircraft.

9. The method according to claim 1, wherein at least one spray (2') from at least one first nozzle (2) is directed obliquely upwards in a vertical plane.

10. The method according to claim 1, wherein a plurality of first nozzles (2) are arranged to spray an extinguishing medium into the area between the floor (3) and the object (1), such as an aircraft, so that the sprays cover a substantial part of the lower surface of the object (1).

11. In fire extinguishing apparatus for at least one of a space, aircraft storage space or hangar comprising at least one first nozzle (2) so directed as, in a activated state, to spray at least one of a fire extinguishing medium or liquid mist in the area between at least one of an object (1) to be protected/extinguished or an aircraft and a floor (3) of the at least one of space, aircraft storage space or hanger, the improvements wherein:

the at least one other first nozzle (2) is arranged for the spray mainly in an area between the at least one of the object (1) or an aircraft and a floor (3) of the at least one of the space, aircraft storage space or hanger and at least in a horizontal plane mainly in one first direction; and at least one other first nozzle (2) is arranged to spray at least one of the extinguishing medium or liquid mist at a distance serially from the one first nozzle (2) at least in a horizontal plane substantially in the one first direction so that the sprays (2') from the first nozzles (2) boost each other by a suction produced by the sprays.

12. The apparatus according to claim 11, wherein apparatus comprising at least one second nozzle (4), which is so directed that, in activated state, it will spray a fire extinguishing medium, especially liquid mist, above the object (1) to be protected/extinguished, such as an aircraft, and means (5, 6) for supplying an extinguishing medium to said nozzle (4).

13. The apparatus according to claim 11, wherein the nozzles (2, 4) are so arranged relative to each other that, due to the action of the suction produced by the spray (2') from at least one first nozzle (2), at least part of the mist of extinguishing medium sprayed by at least one second nozzle (4) is directed into the space between the object (10 to be extinguished, such as the fuselage of an aircraft, and the floor (3).

14. The apparatus according to claim 11, wherein the nozzles (2, 4) are so arranged relative to each other that a plurality of first nozzles (2), when activated, will spray an extinguishing medium mainly in one first direction and a plurality of second nozzles (4) spray in at least one second direction so that the mist of extinguishing medium is kept mainly within the desired area by the currents produced by the sprays.

15. The apparatus according to claim 11, wherein the spray (2') from at least one first nozzle (2) is directed in a horizontal plane mainly in the direction of the longitudinal axis of the aircraft or an axis parallel to it.

16. The apparatus according to claim 11, wherein at least some of the second nozzles (4) are directed to spray substantially towards the upper part of the object (1) to be protected, such as an aircraft, preferably substantially in a radial direction towards the assumed longitudinal axis of the object (1).

17. The apparatus according to claim 11, wherein at least some of the first nozzles (2) are arranged one after the other in the direction of the longitudinal axis of the object and/or side by side at a distance from each other in a direction transverse to the longitudinal axis.

18. The apparatus according to claim 11, wherein at least part of the spray (2') front at least one first nozzle (2) is directed towards the lower part of the object (1) to be protected, such as the bottom of an aircraft.

19. The apparatus according to claim 11, wherein at least one spray (2') from at least one first nozzle (2) is directed obliquely upwards in a vertical plane.

20. The apparatus according to claim 11, wherein a plurality of first nozzles (2) are arranged to spray an extinguishing medium into the area between the floor (3) and the object (1), such as an aircraft, so that the sprays cover a substantial part of the lower surface f the object (1).

* * * * *